US009427841B2

(12) United States Patent
Goldstein et al.

(10) Patent No.: US 9,427,841 B2
(45) Date of Patent: Aug. 30, 2016

(54) DOUBLE-SIDED POLISHING OF HARD SUBSTRATE MATERIALS

(71) Applicant: II-VI Incorporated, Saxonburg, PA (US)

(72) Inventors: Samuel J. Goldstein, Murrieta, CA (US); Stephen M. Miller, III, Temecula, CA (US); John M. O'Donnell, Winchester, CA (US)

(73) Assignee: II-VI Incorporated, Saxonburg, PA (US)

( * ) Notice: Subject to any disclaimer, the term of this patent is extended or adjusted under 35 U.S.C. 154(b) by 142 days.

(21) Appl. No.: 14/215,764

(22) Filed: Mar. 17, 2014

(65) Prior Publication Data

US 2014/0273760 A1 Sep. 18, 2014

Related U.S. Application Data

(60) Provisional application No. 61/787,536, filed on Mar. 15, 2013.

(51) Int. Cl.
*B24B 37/08* (2012.01)
*B24B 37/28* (2012.01)

(52) U.S. Cl.
CPC ..... *B24B 37/08* (2013.01); *B24B 37/28* (2013.01)

(58) Field of Classification Search
CPC ..... B24B 7/17; B24B 37/08; B24B 37/022; B24B 37/044; B24B 37/28
See application file for complete search history.

(56) References Cited

U.S. PATENT DOCUMENTS

| | | | | |
|---|---|---|---|---|
| 1,486,341 | A * | 3/1924 | Hoke | B24B 37/08 451/292 |
| 2,314,787 | A * | 3/1943 | Hunt | B24B 37/08 451/324 |
| 3,395,494 | A * | 8/1968 | Sogn | B24B 37/08 451/1 |
| 5,435,772 | A * | 7/1995 | Yu | B24B 37/24 451/28 |
| 5,800,725 | A | 9/1998 | Kato et al. | |
| 6,376,335 | B1 | 4/2002 | Zhang et al. | |
| 6,419,564 | B2 * | 7/2002 | Herrman | B24D 7/06 451/269 |
| 7,214,124 | B2 | 5/2007 | Kobayashi et al. | |
| 7,727,053 | B2 | 6/2010 | Ueno et al. | |
| 8,118,646 | B2 | 2/2012 | Sato et al. | |

(Continued)

OTHER PUBLICATIONS

Walters, M. et al., "Cost effective fabrication method for large sapphire sensor windows", Proc. of SPIE, 2013, vol. 8884.

(Continued)

*Primary Examiner* — Timothy V Eley
(74) *Attorney, Agent, or Firm* — The Webb Law Firm

(57) ABSTRACT

Disclosed is a method and apparatus for simultaneously polishing both surfaces of an optical substrate. An upper platen and a lower platen, each covered with a polishing pad material and at least one carrier having an aperture for holding the optical substrate between the platens are provided. The location of the aperture of the carrier is set such that the center of the optical substrate is offset from the center of the carrier and at least a portion of the outer perimeter of the optical substrate extends outwardly beyond at least a portion of at least one of the outer perimeter and the inner perimeter of the platens. The platens are rotated with respect to the carrier, and the carrier is rotated with respect to the platens to polish the optical substrate. The location of the aperture of the carrier is adjustable.

18 Claims, 3 Drawing Sheets

(56) References Cited

U.S. PATENT DOCUMENTS 8,283,252 B2 * 10/2012 Taniguchi ..... B24B 37/042 438/691
8,337,280 B2 * 12/2012 Duescher ..... B24B 47/10 451/267
8,545,712 B2 10/2013 Takai et al.
9,004,981 B2 * 4/2015 Fries ..... B24B 7/17 451/262
2009/0042392 A1 * 2/2009 Tokura ..... B24B 55/04 438/692
2009/0305615 A1 * 12/2009 Uchiyama ..... B24B 37/28 451/57
2012/0052771 A1 * 3/2012 Runkel ..... B24B 7/17 451/1

OTHER PUBLICATIONS

Hirose et al., "Optimization of Double-Sided Polishing Conditions to Achieve High Flatness: Consideration of Relative Motion Direction", Int. J. of Automation Technology, 2009, pp. 581-591, vol. 3, No. 5.

* cited by examiner

DOUBLE-SIDED POLISHING OF HARD SUBSTRATE MATERIALS

CROSS REFERENCE TO RELATED APPLICATIONS

This application is based on and claims priority to U.S. Provisional Patent Application No. 61/787,536 filed Mar. 15, 2013, which is hereby incorporated by reference in its entirety.

STATEMENT REGARDING FEDERALLY SPONSORED RESEARCH

This invention was made with government support under Contract No. FA8650-11-D-5703 awarded by the United States Air Force Research Laboratory (AFRL). The government has certain rights in the invention.

BACKGROUND OF THE INVENTION

1. Field of the Invention

The present invention relates to a method of double-sided polishing (DSP) of large format optical substrates, and, more particularly, to a method of double-sided polishing of large format optical substrates to achieve critical levels of optical performance for transmitted wave-front and beam deviation.

2. Description of Related Art

The excellent optical and physical properties of sapphire make it a strong candidate for use in optical systems that must operate in extremely demanding environments where optical transmission in the wavelength range from the visible to the mid-wave infrared is required. Accordingly, sapphire is the material of choice in a variety of current and envisioned applications that include space and military optical systems.

However, it is difficult to process sapphire by conventional fabrication processes due to its high hardness and wear resistance. A great deal of work has been done in the industry to establish useful grinding and polishing processes for small, thin sapphire wafers (typically <6" in diameter and <0.10" thick). But precision finishing technology for larger sapphire substrates is an especially difficult problem. Removal of residual sub-surface damage, final surface smoothness, final panel flatness, and minimization of wedge are all critical characteristics that must be met for large aerospace windows.

For example, there are current airborne optical systems that require single crystal sapphire window panels that are over 20 inches across. Significant challenges exist in the fabrication of these panels. One of the most challenging tasks involves developing high-throughput, cost-effective processing techniques which will ensure that these panels meet extremely stringent optical performance demands while retaining the mechanical strength and durability required for operation in the severe environment of high speed military jet flight profiles.

Optical fabrication involves the stepwise removal of material from an optical substrate with progressively finer grit sizes to yield a polished surface on both sides of the optical element. Conventionally, these operations are performed sequentially on a single surface at a time, first one side and then the other. In the case of high performance optical components, the part must be repeatedly "flipped" and reworked multiple times due to process-induced stress and figure distortion in order to meet the requirements for critical performance characteristics such as transmitted wave-front error (TWE). Therefore, a double-sided polishing (DSP) approach is advantageous in the fabrication of such large transparent panels. In a DSP machine, both surfaces are polished at the same time. Simultaneous removal of nearly equal amounts of material from both surfaces of the optical substrate yields a polished optic in a relatively stress-free condition in a single operation. This is particularly beneficial for large parts with high aspect ratios made from ultra-hard materials, such as sapphire, that must meet stringent TWE requirements.

However, a significant issue with double-sided polishing of large window panels has been achieving the necessary surface flatness for meeting stringent TWE and beam deviation requirements. While maintaining a low wedge is relatively simple in a DSP process, the large panel to platen size ratio and the extreme hardness of the materials such as sapphire tend to result in a bi-convex part with enough power to fail subsequent optical tests.

The prior art describes two basic applications of DSP to the polishing of sapphire. However, the prior art methodologies are for wafer-scale sapphire substrates and focus on mechanical smoothness and flatness of small diameter, thin wafers for use as substrates for GaN deposition (U.S. Pat. Nos. 5,800,725; 6,376,335; 7,214,124; 7,727,053; 8,118,646; and 8,545,712). However, the prior art is silent with respect to larger window substrates and optical performance characteristics.

"Cost effective fabrication method for large sapphire sensor windows," by M. Walters, et al., (Proc. of SPIE Vol. 8884, SPIE, Bellingham, Wash., 2013) describes DSP of small (50 mm) disks for potential optical applications but is also silent with respect to larger substrates.

Thus, a need exists for an apparatus and method for polishing large optical substrates that have the necessary surface flatness for meeting stringent TWE and beam deviation requirements.

SUMMARY OF THE INVENTION

The present invention is directed to a method for simultaneously polishing both surfaces of an optical substrate. An upper platen and a lower platen, each covered with a polishing pad material and at least one carrier having an aperture for holding the optical substrate between the upper platen and the lower platen and adapted to allow the polishing pad material of the upper platen and the lower platen to simultaneously contact an upper surface and a lower surface of the optical substrate are provided. A first location of the aperture of the carrier is set such that the center of the optical substrate may be offset from the center of the carrier and at least a portion of the outer perimeter of the optical substrate extends outwardly beyond at least a portion of at least one of the outer perimeter and the inner perimeter of the upper platen and the lower platen. The upper platen and the lower platen are rotated with respect to the carrier, and the carrier is rotated with respect to the upper platen and the lower platen to polish the optical substrate.

The method may further include stopping the rotation of the upper platen and the lower platen with respect to the carrier and the rotation of the carrier with respect to the upper platen and the lower platen and setting the location of the aperture of the carrier to a second location wherein at least a portion of an outer perimeter of the optical substrate extends outwardly beyond at least a portion of at least one of an outer perimeter and an inner perimeter of the upper platen and the lower platen such that the distance that the outer perimeter of the optical substrate extends beyond the at least one of the outer perimeter and the inner perimeter of the upper platen and the lower platen when the aperture is in the second position may be different from the distance that the outer perimeter of the optical substrate extends beyond the at least one of the outer perimeter and the inner perimeter of the upper platen and the lower platen when the aperture is in the first position.

The distance that at least a portion of the outer perimeter of the optical substrate extends beyond at least a portion of at least one of the outer perimeter and the inner perimeter of the upper platen and the lower platen may be up to one-third of the optical substrate diameter.

At least one of the upper platen surface or the lower platen surface profile may be modified via mechanical bending during operation.

The upper platen and the lower platen may contact the surfaces of the optical substrate with a pressure between 0.5 and 2 psi and may be rotated at a speed between 10 and 30 RPM.

A loose abrasive polishing medium may be applied to the polishing pad material or the polishing medium may be a fixed abrasive integral to the polishing pad material.

The optical substrate may be chosen from the group consisting of: sapphire, spinel, ALON, aluminum oxide, or composite material transparent in the visible and near infrared and mid-wave infrared wavelength regions, may be rectangular, circular or oval, may be between 0.10 inches and 1.00 inch thick, and may have lateral dimensions between 6 inches and 60 inches.

After polishing, the optical substrate and the final maximum transmitted wave-front error over the clear aperture and the final maximum transmitted wave-front error over any sub-aperture of the optical substrate may be less than 0.25 wave rms when measured at normal angle of incidence at 0.6328 micrometers. The final maximum beam deviation of the optical substrate over the clear aperture and the final maximum beam deviation over any sub-aperture of the optical substrate may be less than 5 arc-seconds when measured at normal angle of incidence.

The present invention is also directed to an apparatus for simultaneously polishing both surfaces of an optical substrate comprising: an upper platen and a lower platen, each covered with a polishing pad material; and a carrier having an aperture for holding the optical substrate between the upper platen and the lower platen and adapted to allow the polishing pad material of the upper platen and the lower platen to simultaneously contact an upper surface and a lower surface of the optical substrate, respectively. The upper platen and the lower platen rotate with respect to the carrier, and the carrier rotates with respect to the upper platen and the lower platen. The location of the aperture of the carrier is adjustable such that the distance that at least a portion of the outer perimeter of the optical substrate extends outwardly beyond at least a portion of at least one of the outer perimeter and the inner perimeter of the upper platen and the lower platen can be changed.

The distance that at least a portion of the outer perimeter of the optical substrate extends beyond at least a portion of at least one of the outer perimeter and the inner perimeter of the upper platen and the lower platen may be up to one-third of the optical substrate diameter.

At least one of the upper platen surface or the lower platen surface profile may be adapted to be modified via mechanical bending during operation.

BRIEF DESCRIPTION OF THE DRAWING(S)

DESCRIPTION OF THE INVENTION

In order to meet the most stringent optical performance requirements for transmitted wave-front, every location within the clear aperture of a given optical window must simultaneously exhibit the specified level of flatness and wedge. However, on a practical basis, when a plate is polished via traditional double-sided polishing (DSP) configurations, the finished panel is often prone to exhibit two problematic phenomena that result in a non-compliant window. The first is the effect of edge roll off at the edge region due to a difference in a polishing pressure experienced between the central region of the optical substrate and its edge. In correcting for this problem, typically by using single-side processing (SSP), the second problem is often encountered—stress-induced bow in the plate caused by uneven levels of residual compressive stresses in the two window surfaces, known as the Twyman effect. It is important to note that by its nature, DSP tends to prevent uneven stress loading. It is the single-surface corrective polishing that can induce or accentuate the problem. It is also important to note that these effects become more pronounced as the lateral dimension of the optical substrate increases, e.g., moves from semiconductor substrate wafer size to large aerospace window size.

The present invention is directed to a method by which edge roll off is practically eliminated for large optical substrates while still avoiding the Twyman effect. In summary, a DSP method that creates high flatness over the entirety of the window and reduces the degree of edge roll off along the outer circumference of the window is disclosed.

Figure 1:
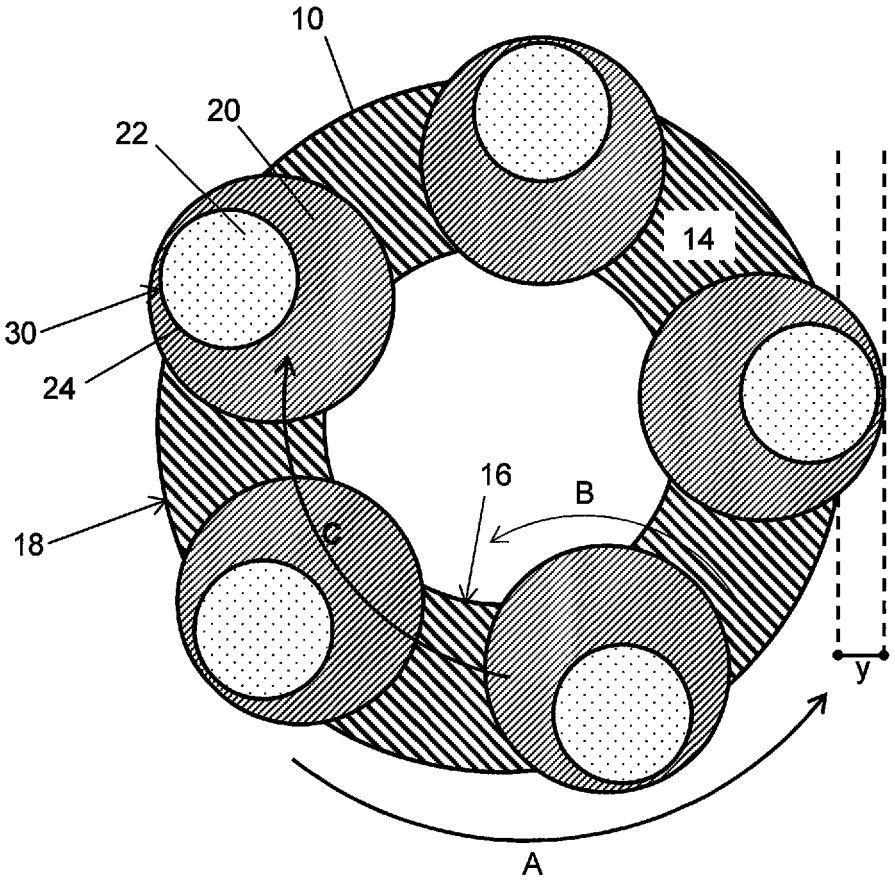
FIG. 1 is a partial top perspective view showing one embodiment of the double-sided polishing apparatus with a portion of the outer perimeter of the optical substrate extending beyond a portion of the outer perimeter and the inner perimeter of the lower platen—the upper platen is not shown.
Figure 2:
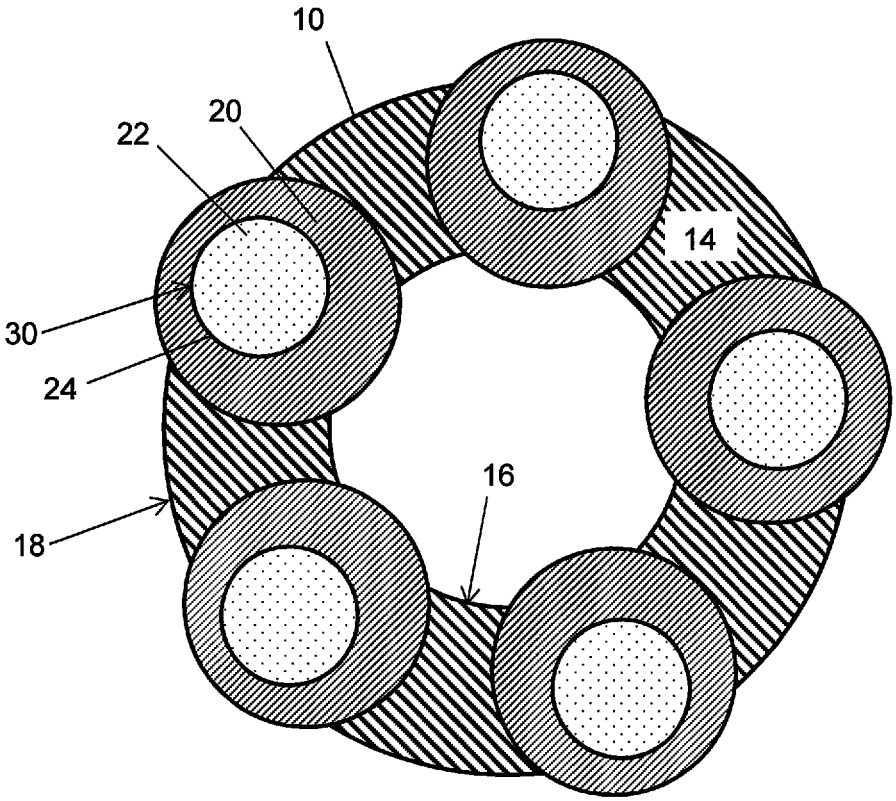
FIG. 2 is a partial top perspective view showing one embodiment of the double-sided polishing apparatus with the outer perimeter and the inner perimeter of the lower platen substantially even with the outer perimeter of the optical substrate—the upper platen is not shown.

As shown in FIGS. 1 and 2, a double-sided polishing machine is provided. The polishing machine has an upper platen (not shown) and a lower platen 10, each having a surface covered with a polishing pad material 14. The surfaces of the upper platen and the lower platen 10 covered with the polishing pad material 14 are parallel to one another. Both the upper platen and the lower platen 10 are rotatable around a central axis perpendicular to the polishing pad material 14 surface as shown by arrow A. The platens can rotate in both clockwise and counter-clockwise directions and the direction of each platen can be controlled independently. The surface of each platen is held flat to within ±0.002".

The upper platen and the lower platen 10 are doughnut-shaped such that they each define an inner perimeter 16 and an outer perimeter 18.

At least one carrier 20 for holding the optical substrate 22 is adapted to be placed between the upper platen and the lower platen 10. The carrier 20 includes an aperture 24 adapted to hold the optical substrate 22. The carrier 20 has a thickness such that when the optical substrate 22 is positioned in the aperture 24 both the upper surface and the lower surface extend beyond the upper surface and the lower surface of the carrier 20, respectively. Preferably, the carrier is as close to the desired final thickness of the optical substrate 22 as possible and the optical substrate 22 extends no more than 10% of its thickness beyond the surface of the carrier 20. This configuration allows the polishing pad material of the upper platen and the polishing pad material 14 of the lower platen 10 to simultaneously polish the upper and lower surfaces of the optical substrate 22, respectively.

A plurality of carriers 20 may be provided as shown in FIGS. 1 and 2. The carriers 20 rotate around their individual central axes as shown by arrow B and around the central axis of the polishing machine as shown by arrow C.

The carriers 20 extend beyond both the outer perimeter 16 and the inner perimeter 18 of the upper platen and the lower platen 10.

Figure 3:
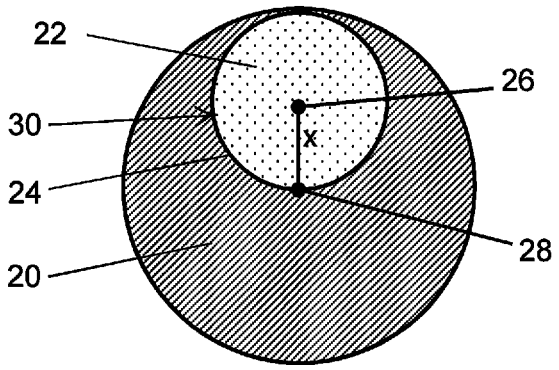
FIG. 3 is a top view of the carrier of FIG. 1.
Figure 4:
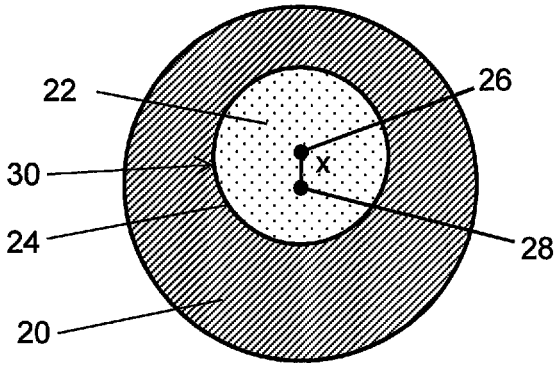
FIG. 4 is a top view of the carrier of FIG. 2.

As shown in FIGS. 3 and 4, the carrier 20 and its surrounding support structure are configured to allow adjustable positioning of the aperture 24 containing the optical substrate 22. The center 26 of the aperture 24 is offset from the center 28 of the carrier 20 and the carrier 20 is adapted such that the distance x between the center 26 of the aperture 24 and the center 28 of the carrier 20 can be changed. As the distance x between the center 26 of the aperture 24 and the center 28 of the carrier 20 is changed, the distance y that outer perimeter 30 of the optical substrate 22 extends beyond the inner perimeter 16 and the outer perimeter 18 of the upper platen and the lower platen 10 is also changed. The distance y may be up to one-third of the diameter or lateral measurement of the optical substrate 22.

As can be seen in FIGS. 1 and 3, setting the distance x between the center 26 of the aperture 24 and the center 28 of the carrier 20 to be large, such that the aperture 24 is located very close to the outer perimeter of the carrier 20, results in the outer perimeter 30 of the optical substrate 22 extending well beyond the inner perimeter 16 and the outer perimeter 18 of the upper platen and the lower platen 10.

As can be seen in FIGS. 2 and 4, setting the distance x between the center 26 of the aperture 24 and the center 28 of the carrier 20 to be small, such that the aperture 24 is located away from the outer perimeter of the carrier 20, results in the outer perimeter 30 of the optical substrate 22 corresponding with the inner perimeter 16 and the outer perimeter 18 of the upper platen and the lower platen 10.

While the figures show the outer perimeter 30 of the optical substrate 22 extending beyond both the outer perimeter 18 and the inner perimeter 16 of the upper platen and the lower platen 10, the outer perimeter 30 of the optical substrate 22 may extend only beyond one of the outer perimeter 18 and the inner perimeter 16 of the upper platen and the lower platen 10.

Adjustment of the aperture 24 may occur in any suitable manner. In one embodiment several carriers 20 having apertures 24 in different positions can be provided. In another embodiment, a slot may be provided in the carrier 20 in which a sample holder having an aperture 24 can be moved from one end to the other to change the position of the aperture 24. In yet another embodiment, the carrier 20 can be provided with several overlapping apertures 24.

The carrier 20 is chosen or adjusted to set the distance y that outer perimeter 30 of the optical substrate 22 extends beyond the inner perimeter 16 and the outer perimeter 18 of the upper platen and the lower platen 10. The optical substrate 22 is loaded in the carrier 20 and the upper platen and the lower platen 10 are brought into contact with the upper and lower surfaces of the optical substrate 22, respectively. The upper platen and lower platen 10 and the carrier 20 are then rotated to polish the optical substrate 22.

After stopping rotation of the upper platen and lower platen 10 and the carrier 20, the flatness of the sample may be measured via a mechanical indicator or interferometically and the carrier 20 may be chosen or adjusted such that the distance y that outer perimeter 30 of the optical substrate 22 extends beyond the inner perimeter 16 and the outer perimeter 18 of the upper platen and the lower platen 10 is changed based on the measurement.

Additionally, the upper platen surface or the lower platen 10 surface profile may be adapted to be modified via mechanical bending during operation. The profile can be modified by using "conditioning gears" to grind the platen to the desired shape. The "conditioning gears" are steel gears having a same shape corresponding to the shape of the carriers that when used with an abrasive compound remove material on the platen. When the platen is measured mechanically and falls out of the process parameters (±0.002") either concave or convex, it is adjusted back using the mechanical bending.

Polishing may be achieved by either feeding an abrasive slurry between the surfaces of the optical substrate and the polishing pad material or by incorporating the abrasive as a fixed medium in the polishing pads themselves. Examples include: an unfilled polyurethane polishing pad material with a conventional slurry of diamond grit mixed one-to-one with deionized water; a polishing pad material of polymer tile with diamond grit fixed in the pad, in which the only required slurry is deionized water to act as a coolant with or without the addition of small volumes of vehicle and a fine grit to help maintain removal rates; or a polyurethane impregnated polyester felt polishing pad used in combination with ultrafine grit slurry.

The pressure between the platens and the optical substrate may be between 0.5 to 2 psi and the rotational speed of the platens may be between 10 and 30 RPM.

The optical substrate may be chosen from sapphire, spinel, ALON, aluminum oxide, or composite material transparent in the visible and near infrared and mid-wave infrared wavelength regions. It may be rectangular, circular or oval. It may have lateral dimensions between 6 inches and 60 inches and a thickness between 0.10 inches and 1.00 inch. Both surfaces of the optical substrate are ground to a flat profile prior to placing it in the carrier.

Optionally, the double-sided polishing described above may be followed by a SSP process step, such as is typically performed on a Continuous Polishing Machine, to provide final figure correction in order to meet the required performance levels for transmitted wavefront and beam deviation.

After polishing, the final maximum transmitted wavefront error over the clear aperture of the optical substrate after polishing is less than 0.25 wave rms when measured at normal angle of incidence at 0.6328 micrometers and the final maximum transmitted wave-front error over any sub-aperture of the optical substrate is less than 0.25 wave rms when measured at normal angle of incidence at 0.6328 micrometers. Also, after polishing, the final maximum beam deviation of the optical substrate over the clear aperture is less than 5 arc-seconds when measured at normal angle of incidence and the final maximum beam deviation over any sub-aperture of the optical substrate is less than 5 arc-seconds when measured at normal angle of incidence.

Although the invention has been described in detail for the purpose of illustration based on what is currently considered to be the most practical and preferred embodiments, it is to be understood that such detail is solely for that purpose and that the invention is not limited to the disclosed embodiments but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A method for simultaneously polishing both surfaces of an optical substrate comprising:

providing an upper platen and a lower platen, each covered with a polishing pad material;

providing at least one carrier having an aperture for holding the optical substrate between the upper platen and the lower platen and adapted to allow the polishing pad material of the upper platen and the lower platen to simultaneously contact an upper surface and a lower surface of the optical substrate, respectively;

setting a first location of the aperture of the carrier such that a center of the optical substrate is offset from a center of the carrier and at least a portion of an outer perimeter of the optical substrate extends outwardly beyond at least a portion of at least one of an outer perimeter and an inner perimeter of the upper platen and the lower platen;

rotating the upper platen and the lower platen;

rotating the carrier;

stopping the rotation of the upper platen and the lower platen;

stopping the rotation of the carrier;

setting a location of the aperture of the carrier to a second location wherein at least a portion of an outer perimeter of the optical substrate extends outwardly beyond at least a portion of at least one of an outer perimeter and an inner perimeter of the upper platen and the lower platen;

rotating the upper platen and the lower platen; and rotating the carrier, wherein a maximum distance during rotation that the outer perimeter of the optical substrate extends beyond the at least one of the outer perimeter and the inner perimeter of the upper platen and the lower platen when the aperture is in the second location is different from a maximum distance during rotation that the outer perimeter of the optical substrate extends beyond the at least one of the outer perimeter and the inner perimeter of the upper platen and the lower platen when the aperture is in the first location.

2. The method of claim 1, wherein, when the aperture is in the first location, at least a portion of the outer perimeter of the optical substrate extends beyond at least a portion of at least one of the outer perimeter and the inner perimeter of the upper platen and the lower platen a distance of up to one-third of the optical substrate diameter.

3. The method of claim 1, wherein at least one of an upper platen surface or a lower platen surface is modified via mechanical bending during rotation of the upper platen and the lower platen.

4. The method of claim 1, wherein the upper platen and the lower platen contact the respective surfaces of the optical substrate with a pressure between 0.5 and 2 psi.

5. The method of claim 1, wherein the upper platen and the lower platen are rotated at a speed between 10 and 30 RPM.

6. The method of claim 1, wherein a loose abrasive polishing medium is applied to the polishing pad material.

7. The method of claim 1, wherein the polishing pad material comprises a fixed abrasive integral to the polishing pad material.

8. The method of claim 1, wherein the optical substrate is chosen from the group consisting of: sapphire, spinel, ALON, aluminum oxide, or composite material transparent in the visible and near infrared and mid-wave infrared wavelength regions.

9. The method of claim 1, wherein the optical substrate is rectangular, circular, or oval.

10. The method of claim 1, wherein the optical substrate is between 0.10 inches and 1.00 inch thick.

11. The method of claim 1, wherein the optical substrate has lateral dimensions between 6 inches and 60 inches and a final maximum transmitted wave-front error over a clear aperture of the optical substrate after polishing is less than 0.25 wave rms when measured at normal angle of incidence at 0.6328 micrometers.

12. The method of claim 1, wherein a final maximum transmitted wave-front error over any sub-aperture of the optical substrate after polishing is less than 0.25 wave rms when measured at normal angle of incidence at 0.6328 micrometers.

13. The method of claim 1, wherein a final maximum beam deviation over a clear aperture of the optical substrate after polishing is less than 5 arc-seconds when measured at normal angle of incidence.

14. The method of claim 1, wherein a final maximum beam deviation over any sub-aperture of the optical substrate after polishing is less than 5 arc-seconds when measured at normal angle of incidence.

15. A method for simultaneously polishing both surfaces of an optical substrate comprising:

providing an upper platen and a lower platen, each covered with a polishing pad material;

providing at least one carrier having an aperture for holding the optical substrate between the upper platen and the lower platen and adapted to allow the polishing pad material of the upper platen and the lower platen to simultaneously contact an upper surface and a lower surface of the optical substrate, respectively;

setting a first location of the aperture of the carrier such that a center of the optical substrate is offset from a center of the carrier and at least a portion of an outer perimeter of the optical substrate extends outwardly beyond at least a portion of at least one of an outer perimeter and an inner perimeter of the upper platen and the lower platen;

rotating the upper platen and the lower platen;

rotating the carrier;

stopping the rotation of the upper platen and the lower platen;

stopping the rotation of the carrier;

setting the location of the aperture of the carrier to a second location wherein at least a portion of an outer perimeter of the optical substrate extends outwardly beyond at least a portion of at least one of an outer perimeter and an inner perimeter of the upper platen and the lower platen;

rotating the upper platen and the lower platen; and rotating the carrier, wherein a distance between the center of the aperture and the center of the carrier when the aperture is in the first location is different from a distance between the center of the aperture and the center of the carrier when the aperture is in the second location.

16. An apparatus for simultaneously polishing both surfaces of an optical substrate comprising:

an upper platen and a lower platen, each covered with a polishing pad material; and a carrier having an aperture for holding the optical substrate between the upper platen and the lower platen and adapted to allow the polishing pad material of the upper platen and the lower platen to simultaneously contact an upper surface and a lower surface of the optical substrate, respectively, wherein the upper platen and the lower platen rotate; and the carrier rotates, and a location of a center of the aperture of the carrier is adjustable with respect to a center of the carrier such that a distance that at least a portion of an outer perimeter of the aperture extends outwardly beyond at least a portion of at least one of an outer perimeter and an inner perimeter of the upper platen and the lower platen can be changed.

17. The apparatus of claim 16, wherein at least a portion of the outer perimeter of the aperture extends outwardly beyond at least a portion of at least one of the outer perimeter and the inner perimeter of the upper platen and the lower platen a distance of up to one-third of a diameter of the aperture.

18. The apparatus of claim 16, wherein at least one of an upper platen surface or a lower platen surface is adapted to be modified via mechanical bending during rotation of the upper platen and the lower platen.

* * * * *